United States Patent [19]

Hauser et al.

[11] 4,134,686

[45] Jan. 16, 1979

[54] PORTABLE CEMENT MIXER

[75] Inventors: Hans Hauser; Jon A. Violet, both of Fredericktown, Ohio

[73] Assignee: The J. B. Foote Foundry Co., Fredericktown, Ohio

[21] Appl. No.: 833,086

[22] Filed: Sep. 14, 1977

[51] Int. Cl.[2] ..... B28C 5/18

[52] U.S. Cl. ..... 366/47; 280/504; 366/218

[58] Field of Search ..... 366/45–48, 366/218; 248/188.5, 219.1; 280/504, 511, 47.17, 63; 52/730, 731

[56] References Cited

U.S. PATENT DOCUMENTS

| | | | |
|---|---|---|---|
| 2,453,583 | 11/1948 | Muller | 366/47 |
| 2,499,052 | 2/1950 | Brookins | 366/47 |
| 3,768,785 | 10/1973 | Susemihl | 366/47 |

FOREIGN PATENT DOCUMENTS

| | | | |
|---|---|---|---|
| 649653 | 12/1962 | Italy | 52/731 |

*Primary Examiner*—Leonard D. Christian
*Attorney, Agent, or Firm*—Allen D. Gutchess, Jr.

[57] ABSTRACT

A portable cement mixer is provided with an improved supporting frame. The supporting frame includes a first, generally triangularly-shaped end frame comprising two upwardly-converging struts and intermediate cross struts. The second end frame comprises a single upright member. A transverse strut connects a central portion of the cross struts of the first end frame with an intermediate portion of the upright strut of the second end frame. The transverse strut is of rectangular cross section but varying in width and thickness from one end to the other. The new supporting frame is of simple construction and is easier to assemble. It is also sturdier and provides a three-point support for the mixer which can be more readily adapted to uneven ground.

8 Claims, 9 Drawing Figures

PORTABLE CEMENT MIXER

This invention relates to a portable cement mixer and particularly to a supporting frame therefor.

The new supporting frame includes a generally triangularly-shaped end frame comprising two converging, angular struts and intermediate cross struts connecting intermediate portions of the angular struts. A second end frame comprises a single upright member which is U-shaped in transverse cross section. A transverse strut connects the central portion of the cross struts of the first end frame with an intermediate portion of the upright member. The transverse strut varies in width and thickness over its length, being of rectangular cross section throughout, however. The transverse strut is considerably wider than it is thick at the first end frame and is considerably thicker than it is wide at the second end frame. This shape contributes significantly to the overall sturdiness of the supporting frame.

The new supporting frame is of simpler construction than those heretofore known and is easier to assemble when purchased in the knock-down form. The new supporting frame also provides a three-point support which can be more readily adapted to uneven ground.

It is, therefore, a principal object of the invention to provide a portable cement mixer with an improved supporting frame having the advantages set forth above.

Other objects and advantages of the invention will be apparent from the following detailed description of a preferred embodiment thereof, reference being made to the accompanying drawings, in which.

Figure 1:
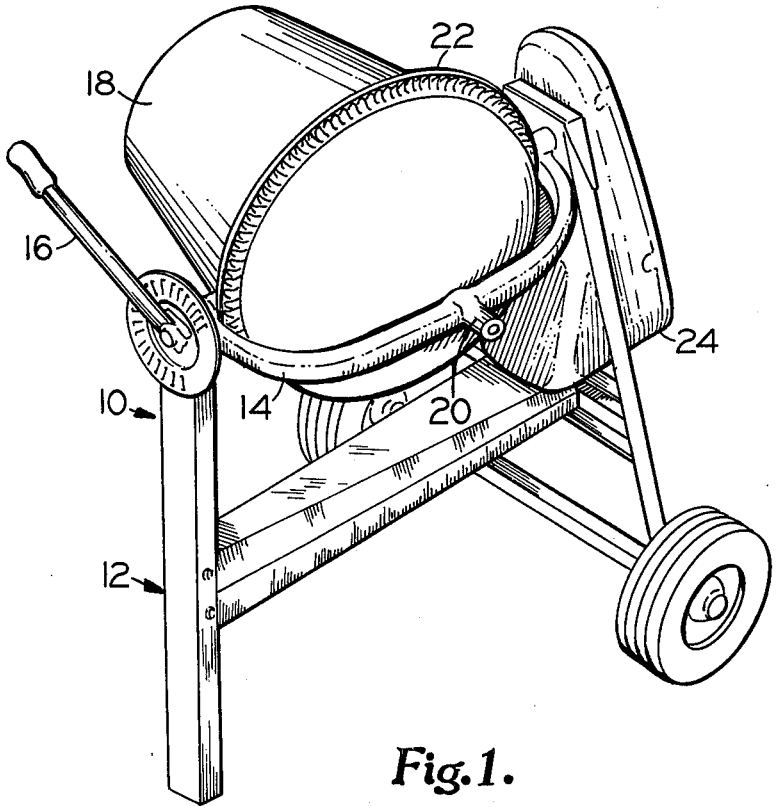
FIG. 1 is a somewhat schematic view in perspective of a portable cement mixer embodying the invention.

Referring now particularly to FIG. 1, a small cement mixer typically used by small contractors and home owners is indicated by the reference numeral 10. Most mixers of this type have a capacity of from about one-half to as much as five cubic yards and are designed to be relatively easily moved about in this instance by hand. The cement mixer 10 includes a main supporting frame 12 which pivotally supports a drum yoke 14 having one end connected to a crank arm 16 which can be manipulated to pivot the yoke. A mixing drum 18 is rotatably mounted on an intermediate portion of the yoke 14 by means of a bearing and axle assembly 20. To rotate the mixing drum 18, a circular ring gear 22 extends around an intermediate portion thereof. A pinion gear (not shown) meshes with the ring gear 22 and is located at the end of the yoke opposite the crank arm 16, being driven through pulleys, a V-belt, and a motor located in a motor housing or cover 24.

Figure 2:
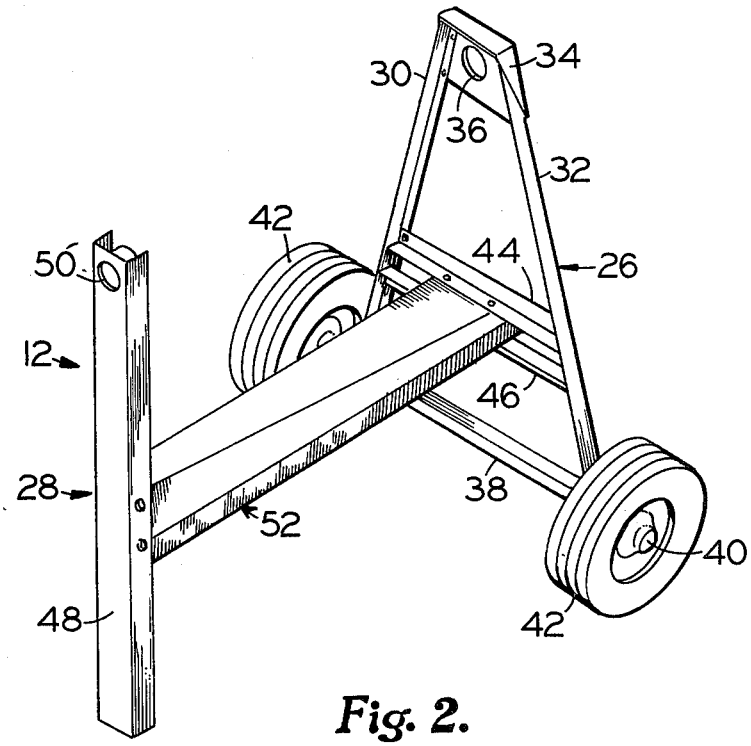
FIG. 2 is a view in perspective of a supporting frame of the mixer of FIG. 1.
Figure 4:
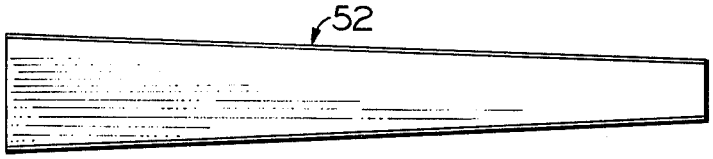
FIG. 4 is a plan view of a transverse strut of the supporting frame.
Figure 3:
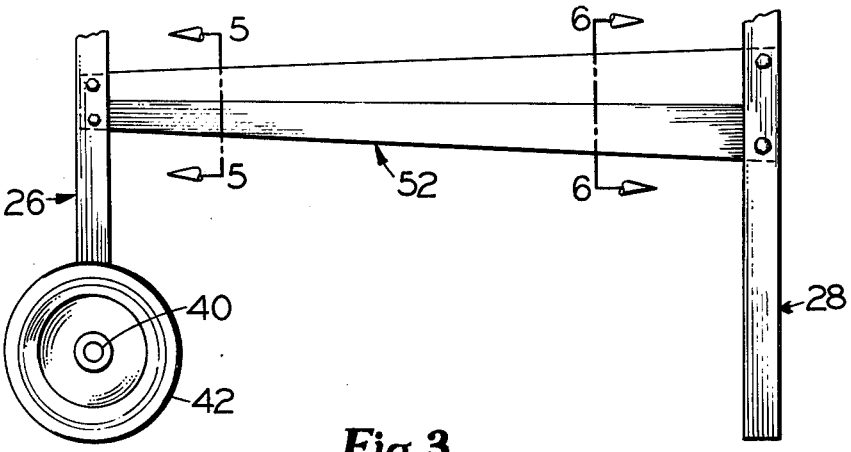
FIG. 3 is a fragmentary side view in elevation of the supporting frame of FIG. 2.

Referring to FIGS. 2 and 3, the supporting frame 12 has a first end frame 26 and a second end frame 28. The first end frame 26 includes two converging, angular legs 30 and 32 of angle iron. These are connected at the top by a bracket 34 having an opening 36 through which a drive shaft for the pinion gear meshing with the ring gear 22 extends. A horizontal end strut 38 is affixed to the lower ends of the angular struts 30 and 32 and has axles 40 extending outwardly beyond the ends thereof to rotatably receive wheels 42. At intermediate portions of the angular struts 30 and 32 are horizontal cross struts 44 and 46 of angle iron with the vertical flange of the upper strut 44 pointing upwardly and the vertical flange of the lower strut 46 extending downwardly.

The second end frame 28 includes a single upright member 48 having an opening 50 at its upper end to rotatably receive a shaft for the crank arm 16. The upright member 48 is U-shaped in transverse cross section with the legs being spaced apart a predetermined distance.

Figure 5:
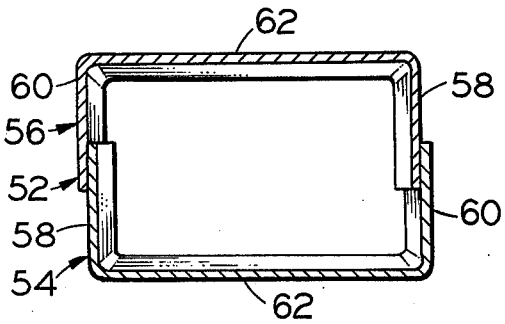
FIG. 5 is a view in transverse cross section taken along the line 5—5 of FIG. 3.
Figure 6:
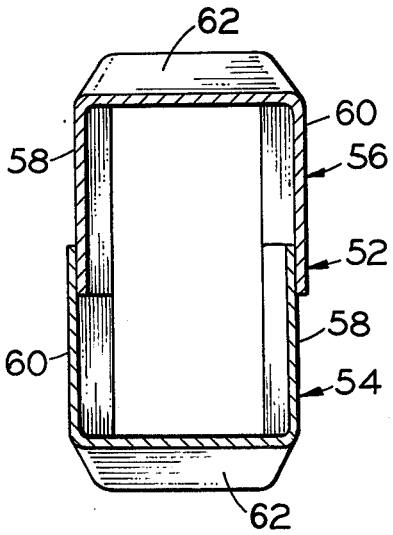
FIG. 6 is a view in transverse cross section taken along the line 6—6 of FIG. 3.

A transverse strut 52 extends between the end frames 26 and 28. More specifically, the transverse strut is fastened to central portions of the horizontal flanges of the cross struts 44 and 46 of the end frame 26 and to intermediate portions of the legs of the upright member 48 of the end frame 28. As shown in FIGS. 5 and 6 in particular, the transverse strut 52 is made of two identical tapered beams 54 and 56 of generally U-shaped cross section, having legs 58 and 60 and a connecting web 62. The beams 54 and 56 are turned to face one another with the legs 58 and 60 in overlapping relationship, being welded together or otherwise suitably affixed. This forms a rectangular transverse cross section for the transverse strut 52 with the size and shape of the cross section varying from one end to the other. At the end of the transverse strut 52 near the first end frame 26, the strut is considerably wider than it is thick, with the width substantially exceeding the thickness, as shown in FIG. 5. At the end of the transverse strut 52 near the second end frame 28, the strut is considerably thicker than it is wide, with the thickness substantially exceeding the width, as shown in FIG. 6. The thickness of the strut at the first end frame 26 equals the spacing of the horizontal flanges of the cross struts 44 and 46. At the end near the second end frame 28, the width of the strut 52 equals the spacing of the legs of the upright member 48.

The lower peripheries of the wheels 42 and the lower end of the upright member 48 form a three-point support for the mixer 10 which enables it to be more readily adapted to uneven ground. Further, with the use of the single upright member 48 for the end frame 28 and with the single transverse strut 52 connecting the end frame, the supporting frame 12 is relatively simple and is easier to assemble than those heretofore known, involving about two-thirds of the frame elements heretofore employed. The transverse strut 52 and its unique shape also impart a degree of stability and rigidity to the mixer which has not heretofore been obtained.

Figure 7:
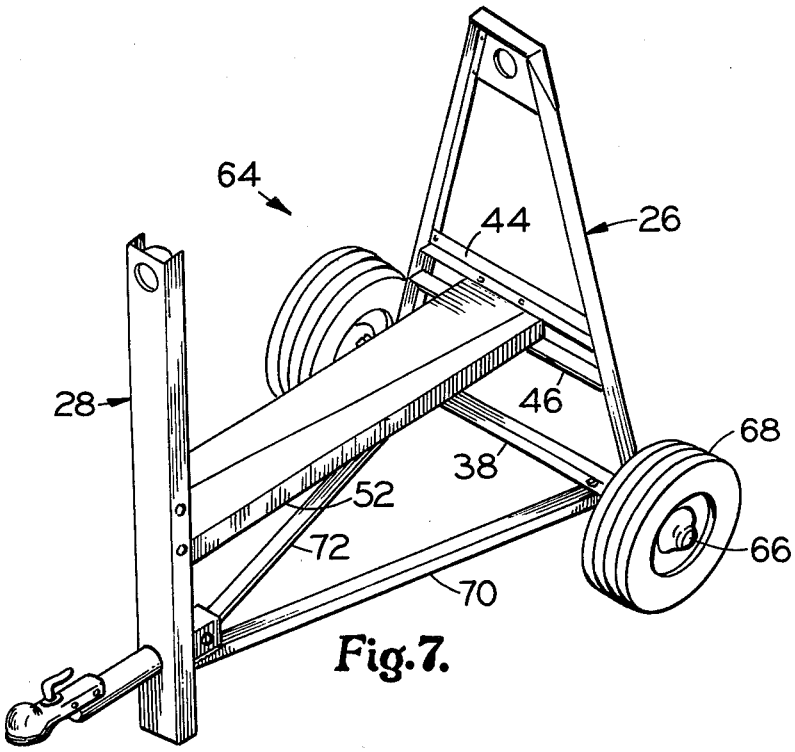
FIG. 7 is a view in perspective, similar to FIG. 2, of a modified supporting frame of the mixer.
Figure 8:
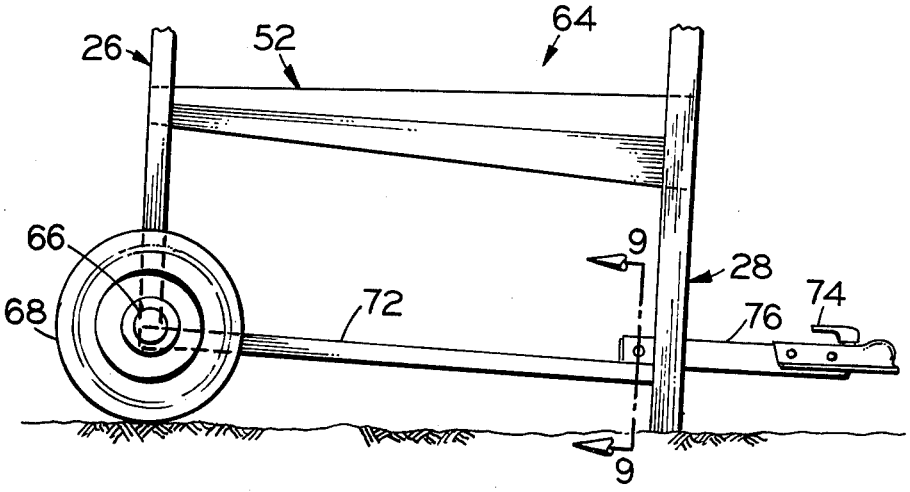
FIG. 8 is a fragmentary side view in elevation of the modified supporting frame.
Figure 9:
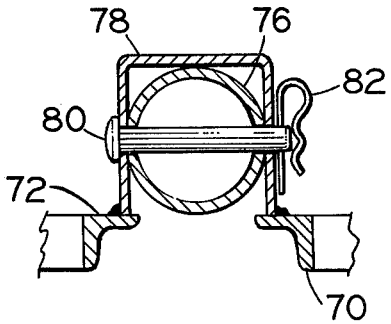
FIG. 9 is an enlarged view in transverse cross section taken along the line 9—9 of FIG. 8.

A modified supporting frame for the mixer as shown in FIGS. 7–9 and is specifically designed to be towable behind a vehicle. The modified supporting frame 64 has the first end frame 26 and the second end frame 28. The horizontal end strut 38 of the end frame 26 has larger axles 66 extending outwardly therefrom to rotatably receive larger wheels 68 designed to rotate at vehicle speeds.

In addition to the transverse strut 52, the supporting frame 64 has two lower diagonal struts 70 and 72 extending from near the ends of the end strut 38 to a lower portion of the second end frame 28.

A trailer hitch 74 is provided at the end frame 28 and is affixed to a tongue 76 of circular transverse cross section. The tongue 76 extends through a suitable opening in the end frame 28 and is received in a square tube 78 which is welded (FIG. 9) to the upper inwardly-facing flanges of the diagonal struts 70 and 72. The tongue 76 is affixed to the side walls of the square tube 78 by a clevis pin 80 and a clip 82. These allow the tongue 76 to be unfastened from the square tube 78, so that the tongue 76 can be moved into the square tube 78 for storage when the mixer 10 is not being towed.

The tongue 76 and the hitch 74 are sufficiently low that when the hitch 74 is placed upon a ball of a towing vehicle, the lower end of the end strut 28 will be safely off the ground.

Various modifications of the above-described embodiments of the invention will be apparent to those skilled in the art, and it is to be understood that such modifications can be made without departing from the scope of the invention, if they are within the spirit and the tenor of the accompanying claims.

We claim:

1. A portable cement mixer comprising a first end frame having two angular struts converging in an upwardly direction, a bracket connecting the upper ends of said angular struts, a cross strut connecting intermediate portions of said angular struts, a second end frame comprising a single upright member, a transverse strut connecting a central portion of said cross strut and an intermediate portion of said upright member, a drum yoke supported by an upper end of said upright member and said bracket, axle means carried by lower end portions of said angular struts and extending outwardly from said angular struts in opposite directions, a pair of wheels rotatably mounted on said axle means, a lower end of said upright member being substantially in the same plane as the lower peripheries of said wheels when said yoke is substantially horizontal.

2. A portable cement mixer according to claim 1 characterized by a horizontal end strut connected between lower portions of said angular struts below said cross strut, two diagonal struts connecting outer portions of said horizontal end strut and a lower portion of said upright frame member, a lower portion of said upright frame member having an opening, a tongue extending through said opening, a tubular member affixed to said diagonal struts and receiving an end of said tongue therein, and a readily removable fastener extending through said tongue and said tubular member.

3. A portable cement mixer according to claim 1 characterized by said transverse strut being wider at the first end frame than at the second end frame and being thicker at the second end frame than at the first end frame.

4. A portable cement mixer according to claim 1 characterized by said transverse strut being wider than it is thick at said first end frame and thicker than it is wide at said second end frame.

5. A portable cement mixer comprising a first end frame and a second end frame, axle means extending from said first end frame, a pair of wheels rotatably mounted on said axle means, a drum yoke supported by upper end portions of said first and said second end frames, and a transverse strut connecting intermediate portions of said first and second end frames, said transverse strut being wider at a first end near said first end frame than at a second end near said second end frame and being thicker at the second end near said second end frame than at the first end near said first end frame, said transverse strut also tapering uniformly in width and thickness between the ends thereof.

6. A portable cement mixer according to claim 5 characterized by said first end frame having two angular struts converging in an upwardly direction and two generally horizontal, spaced cross struts connecting intermediate portions of said two angular struts, said second end frame comprising a single upright member, said first end of said transverse strut extending between said two cross struts and being affixed to central portions of said cross struts, said second end of said transverse strut being affixed to an intermediate portion of said upright member.

7. A portable cement mixer according to claim 6 characterized by said generally horizontal, spaced cross struts having horizontal flanges to which said first end of said transverse strut is connected, said single upright member being of generally U-shaped configuration in transverse cross section with legs spaced apart a predetermined distance, said second end of said transverse strut extending between said legs and being affixed to said legs at the intermediate portion of said upright member.

8. A portable cement mixer according to claim 7 characterized by the thickness of said first end of said transverse strut being substantially equal to the spacing between the horizontal flanges of said cross struts, and the width of said second end of said transverse strut being substantially equal to the distance between the legs of said upright member.

* * * * *